US006410113B1

(12) United States Patent
Roth

(10) Patent No.: US 6,410,113 B1
(45) Date of Patent: Jun. 25, 2002

(54) DUAL SKIP LABEL LAMINATE

(75) Inventor: Joseph D. Roth, Springboro, OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/408,240

(22) Filed: Sep. 29, 1999

(51) Int. Cl.[7] ..... B42D 15/00

(52) U.S. Cl. ..... 428/41.8; 283/81; 283/98; 283/100; 283/101; 283/108; 428/40.1; 428/42.1; 428/42.2; 428/43; 428/137; 428/138; 428/201; 428/202; 428/914

(58) Field of Search ..... 428/40.1, 42.1, 428/42.2, 138, 43, 41.8, 137, 201, 202, 914; 283/81, 98, 100, 101, 108

(56) References Cited

U.S. PATENT DOCUMENTS

| | | | | |
|---|---|---|---|---|
| 4,182,789 A | | 1/1980 | Castelluzzo | 428/40.1 |
| 5,466,502 A | * | 11/1995 | Wilkinson | 428/40.1 |
| 5,580,640 A | | 12/1996 | Kraft et al. | 428/195 |
| 5,704,650 A | * | 1/1998 | Laurash | 283/81 |
| 6,040,026 A | * | 3/2000 | Iwabuchi | 428/40.1 |

FOREIGN PATENT DOCUMENTS

| | | |
|---|---|---|
| DE | 19653890 | 6/1998 |
| WO | 9000788 | 1/1990 |
| WO | 9511504 | 4/1995 |

OTHER PUBLICATIONS

Rawlings, U.S. Patent Application Serial No. 09/261,779 (NCR Docket No. 8174).

Rawlings, U.S. Patent Application Serial No. 09/261,780 (NCR Docket No. 8175).

Rawlings, U.S. Patent Application Serial No. 09/363,603 (NCR Docket No. 8228).

Roth et al., U.S. Patent Application Serial No. 09/363,602 (NCR Docket No. 8233).

Beacon Chemical Company, Inc., "Pattern Adhesive & Release," *Label & Narrow Web Industry*, Mar. 1998, four pages.

Wallace.com, "New Product Announcements," printed May 1999.

Federal Express Sample.

* cited by examiner

*Primary Examiner*—Nasser Ahmad
(74) *Attorney, Agent, or Firm*—Francis L. Conte

(57) ABSTRACT

A label laminate includes a release liner and label bonded thereto by an adhesive. The liner includes a skip in the release thereof, and the label includes a skip in the adhesive thereof aligned therewith. The label is removable from the liner, and the release skip may be printed thereon.

20 Claims, 4 Drawing Sheets

DUAL SKIP LABEL LAMINATE

BACKGROUND OF THE INVENTION

The present invention relates generally to labels, and, more specifically, to address labels.

Mailers are available in various configurations and sizes for sending various items from a sender at one address to a recipient at another address. A typical mailer is in the form of a container such as a flat envelope, rectangular box, or a cylindrical tube, for example, in which paper correspondence or three dimensional articles may be packaged for delivery.

Recipient and return addresses may be printed directly on the mailers, or may be applied thereto in the form of pressure sensitive labels. Such labels are commonly found in a string or sheet of multiple labels permitting batch addressing to various recipients, commonly from a single sender.

A typical label sheet is a laminate containing several labels adhesively bonded to a common underlying release liner, typically referred to as pressure sensitive labels. Correspondence addresses may be printed on the individual labels in a suitable printer, with the labels then being individually peeled from the liner and affixed to corresponding mailers using the same adhesive found on the back side of the labels. The mailer may then be suitably shipped through the U.S. Postal Service, or private carrier, or local courier to the intended recipient.

When containers are used to ship merchandise to a customer, it is common for the customer to use the same container to return to the sender the merchandise when it fails to meet requirements. The original recipient address must then be obliterated by being either removed or marked over, or a new label may be affixed over the original recipient address. Should the container have a separate return address thereon from the original sender, that return address must also be removed or supplanted.

The quality and security of the replacement addresses on the same container may vary significantly depending on the care and method used for readdressing. In the worst case, a reapplied label may fall off during the return trip of the container, and interrupt the delivery.

In many commercial transactions, merchandise may only be returned with advanced permission and a corresponding return authorization (RA) number therefor. The RA number is typically obtained by phone, and is typically placed on the return label itself for ready visibility by the original sender upon receipt of the container.

Accordingly, it is desired to provide an improved shipping label for both sending a container to a recipient, and returning the same container to a second recipient, such as the original sender.

BRIEF SUMMARY OF THE INVENTION

A label laminate includes a release liner and label bonded thereto by an adhesive. The liner includes a skip in the release thereof, and the label includes a skip in the adhesive thereof aligned therewith. The label is removable from the liner, and the release skip may be printed thereon.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
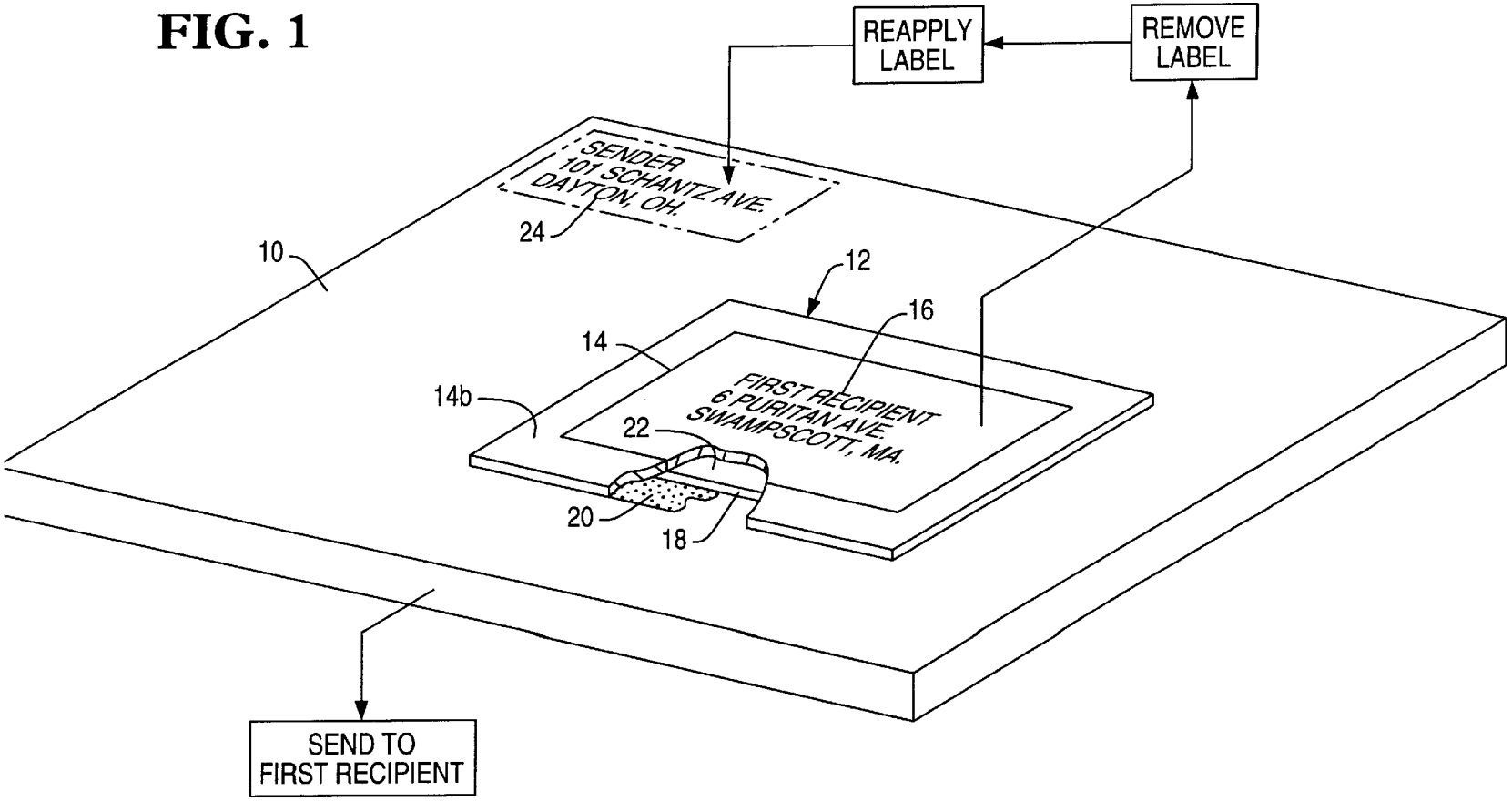
FIG. 1 is an isometric view of a shipping container having a shipping label in accordance with an exemplary embodiment of the present invention.

Illustrated in FIG. 1 is a shipping container 10 configured for shipping an item or article to a recipient. The container may take any conventional form such as the rectangular box illustrated, or a cylindrical shipping tube, or flat envelopes, for example. The article may have any conventional form such as merchandise, or written correspondence of one or more sheets, for example. And, the container may be mailed or shipped using any suitable means such as U.S. Postal Service, or private carrier, or local courier, for example.

A shipping label or laminate 12 is provided in accordance with one embodiment of the present invention for attachment to the container for identifying the recipient, as well as permitting re-shipment of the same container to a second recipient, which may be the original sender. The laminate 12 includes a pressure sensitive address label 14 having a front face or surface upon which may be printed a recipient first address 16.

A release liner 18 is initially disposed under the label, with the label being releasably bonded thereto by a suitable adhesive 20 covering the back side or surface of the label. The liner may have any conventional configuration including a release agent 22, such as silicone, coated thereon for permitting removal of the label by being peeled away therefrom. The adhesive typically used for pressure sensitive labels is permanently bonded to the label back and is releasable from the liner so that the label may be reapplied to other surfaces as desired.

Figure 2:
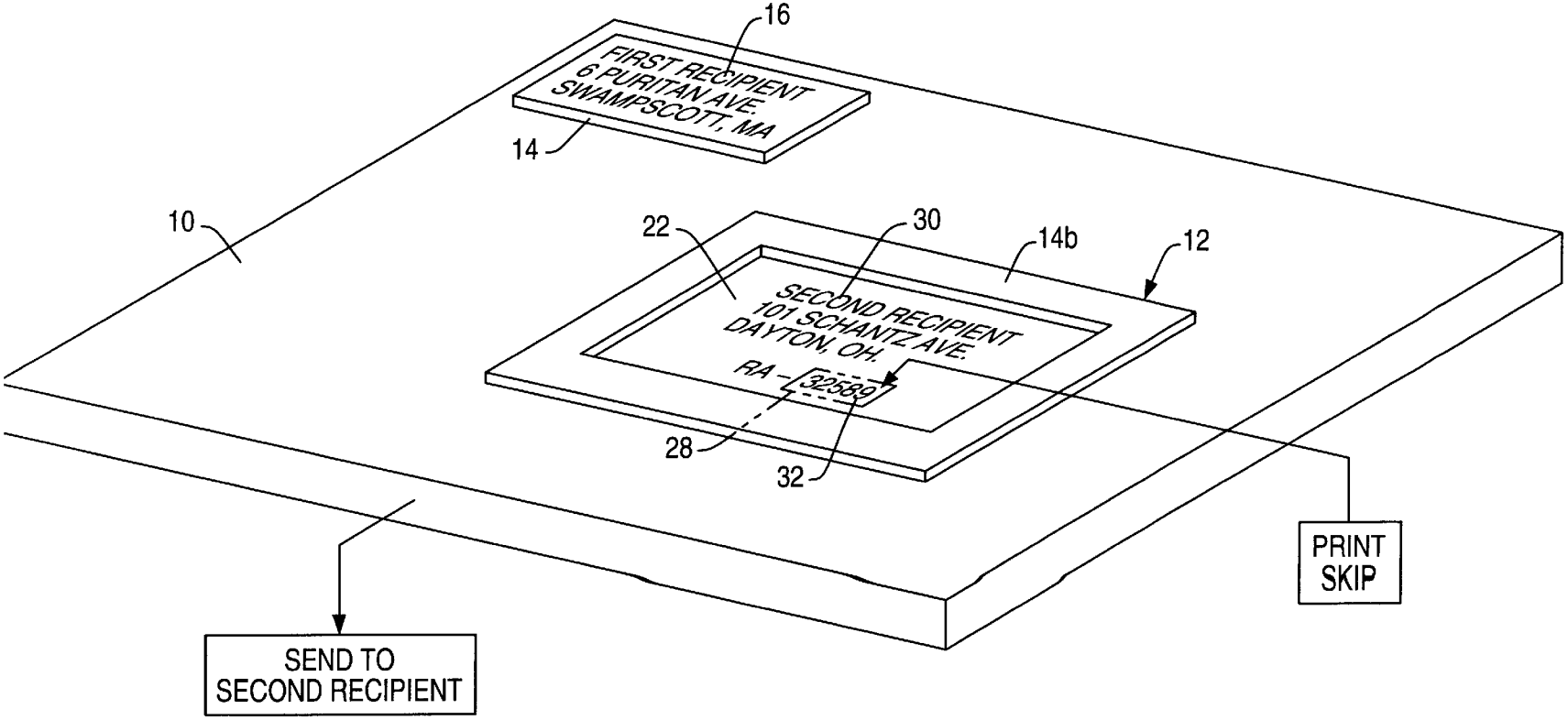
FIG. 2 is an isometric view of the container illustrated in FIG. 1 with the shipping label removed from an underlying liner and reaffixed atop the return address for returning the container to the sender.

In FIG. 1, the shipping laminate 12 has been bonded to the container for initial shipment to the identified first recipient. The container also includes a return address 24 suitably located. In FIG. 2, the label 14 has been removed by the recipient and re-applied atop the return address using the same adhesive found on the back of the label.

Figure 3:
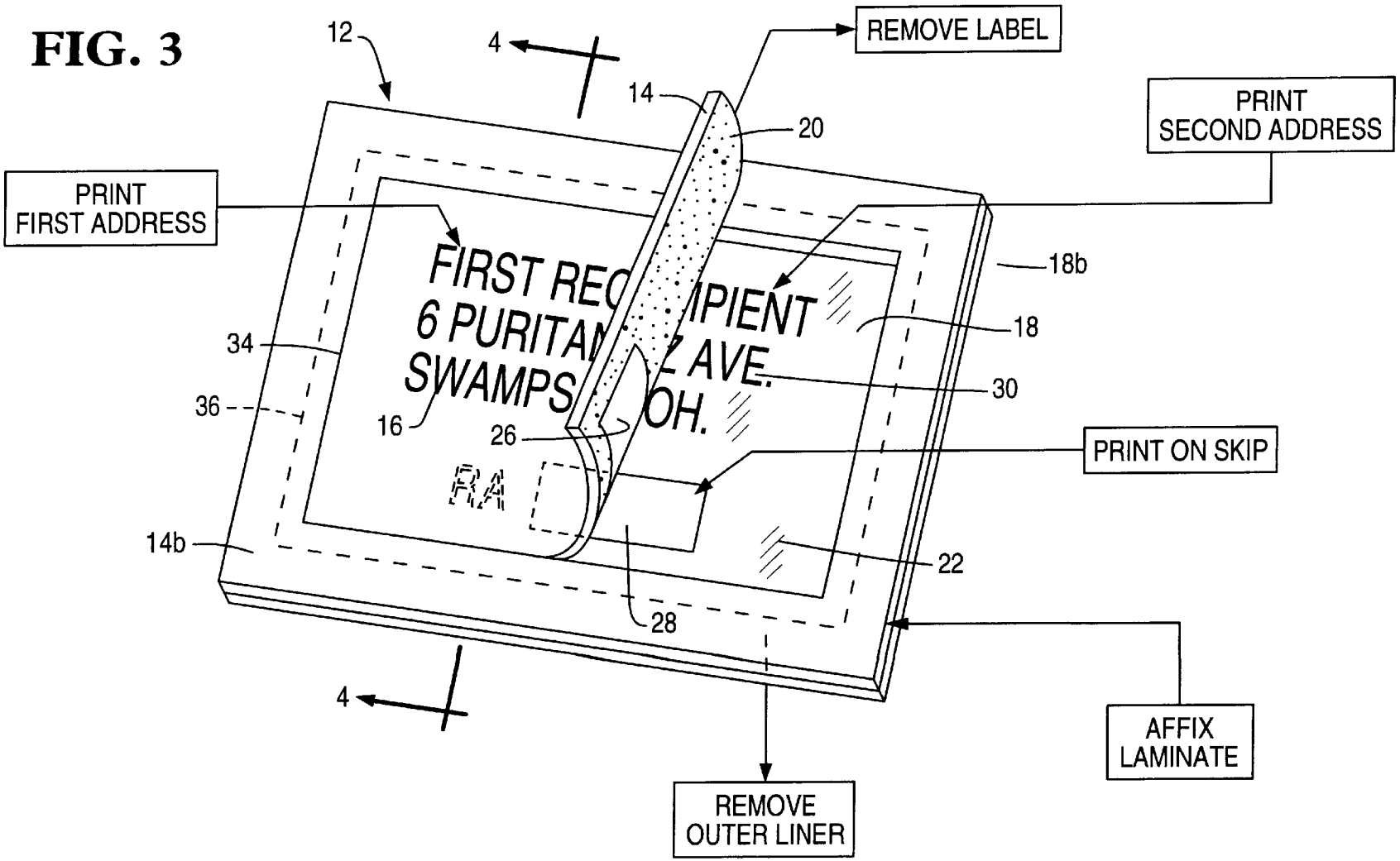
FIG. 3 is an isometric view of the shipping laminate in accordance with a preferred embodiment of the present invention, including a corresponding flow chart for its use.
Figure 4:
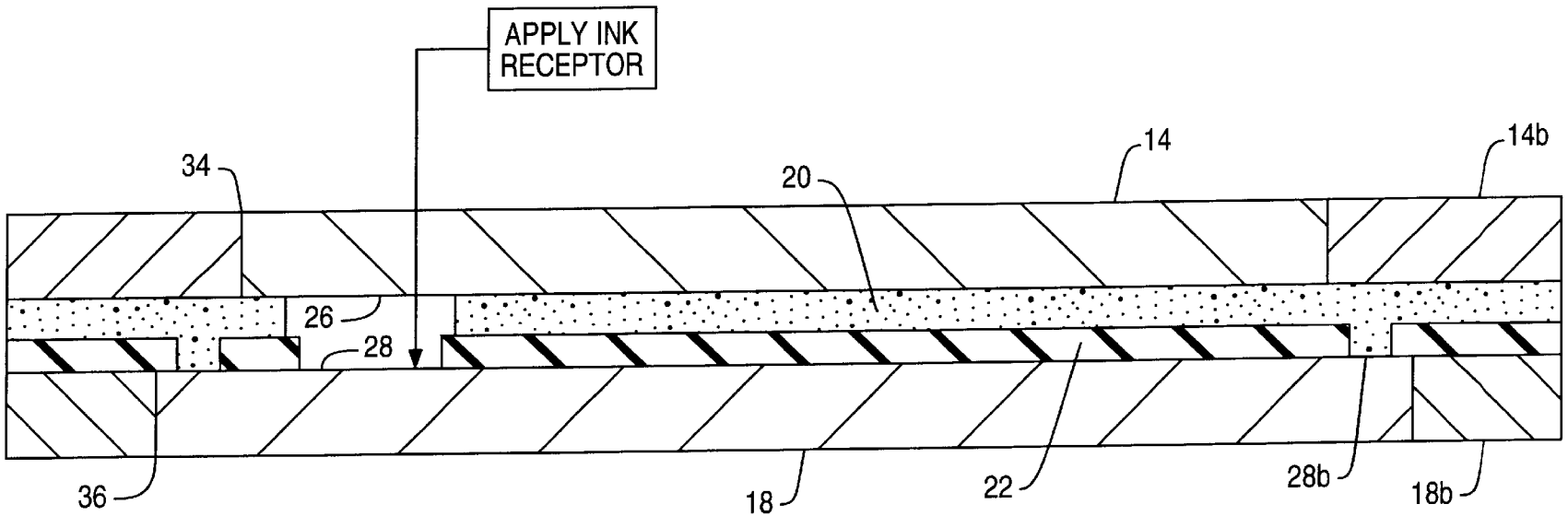
FIG. 4 is a transverse sectional view through the laminate illustrated in FIG. 3 and taken along line 4—4.

The shipping laminate 12 itself, prior to attachment to the container, is illustrated in more detail in FIGS. 3 and 4. The label 14 is initially laminated atop at the liner 18, with the adhesive 20 on the back side of the label providing a weak bond with the silicone release 22 on the front side of the liner.

In accordance with the present invention, the label 14 includes an adhesive skip 26 on the back side of the label which is devoid of the adhesive 20. Correspondingly, the liner includes a release skip 28 on the front side thereof which is devoid of the release 22 thereon. The adhesive skip 26 is aligned atop the release skip 28 for preventing bonding between the label and liner thereat.

The release skip 28 preferably has a surface finish which is receptive for printing thereatop useful information as desired. The liner 18 may be formed of any conventional material, such as various plastics or glassine paper which may permit undesirable smudging of printing thereatop depending upon the type of ink/toner used. Accordingly, the release skip 28 preferably includes a suitable ink or toner receptor impregnated therein for improving the permanence of printing thereatop.

Since the typical release 22, such as silicone, may not itself be printed upon with any permanence, the release skip 28 illustrated in FIG. 3 permits printing directly atop the liner 18 without interference by the release 22.

However, without the use of the release agent in the skip 28, the label 14 would form a permanent bond with the liner preventing its separation therefrom, except for the use of the corresponding adhesive skip 26 on the back of the label. In this way, the label forms a weak bond with the liner over the laminated adhesive 20 and release 22, without any bond between the corresponding skips 26,28.

The dual skip shipping label laminate 12 illustrated in FIG. 3 may be used to advantage in the initial forwarding and return of the same container 10 illustrated in FIGS. 1 and 2. The container is simply addressed by initially printing the recipient first address 16 atop the label in any suitable manner, either by hand, or by printer.

As shown in FIGS. 2 and 3, a recipient second address 30 is printed below the release 22, which is transparent, in any conventional manner. For example, the second address 30 may be printed directly atop the liner 18 itself, prior to the application of the release 22 thereatop. Or, the liner 18 may be transparent, and the second address 30 may be printed atop the container prior to affixing the shipping laminate thereatop. The second address would then be viewable directly through the clear liner. Or, the second address may be printed in mirror form on the back side of the clear liner for correct viewing from the front side thereof.

The shipping laminate 12 may then be suitably affixed to the container 10 as illustrated in FIG. 1, with the first address 16 being visible. The container may then be suitably sent to the indicated first address of the first recipient.

The first recipient may then remove the label 14 from the underlying liner to expose to view the second address 30 and the release skip 28.

In the event the recipient chooses to return merchandise using the same container 10, the recipient obtains, by phone by example, a return authorization (RA) number 32 which is then suitably printed atop the release skip 28. The same container 10 may then be re-sent to the indicated second address 30, which may be the same address as the original sender.

In this way, the same shipping laminate 12 may be used both in the initial shipment of the container and its return, using the pre-printed features of the original label 14 and the underlying liner. The first recipient need only print the desired RA number in the release skip 28 specifically provided therefor. Printing in the release skip 28 is permanent, without undesirable smudging, and the original release 22 does not interfere therewith.

In the preferred embodiment illustrated in FIGS. 3 and 4, the shipping laminate also includes a label rim or border 14*b* surrounding the label 14 and being laterally coextensive therewith. The label border also includes the adhesive 20 coated on the back surface thereof for bonding the border to the liner.

The label 14 and its border 14*b* preferably comprise a common face sheet including a perimeter die cut 34 therebetween as illustrated in FIGS. 3 and 4.

Correspondingly, the liner 18 includes a surrounding border 18*b* therearound in a common back sheet separated by a perimeter die cut 36 therebetween. As shown in FIG. 4, the label die cut 34 preferably extends through the label face sheet and through the adhesive 20 down to the release layer. The liner die cut 36 preferably extends though the liner back sheet and the release 22 up to the adhesive 20.

In order to increase the integrity of the die cut label and liner laminate, the liner preferably includes an additional release skip 28*b* around the perimeter thereof inboard of the liner die cut 36 so that the adhesive 20 may directly bond the label border 14*b* to the liner 18. In this way, the liner border 18*b* and the label 14 may be independently removed from the remainder of the laminate 12 in which the label border 14*b* remains fixedly joined to the central liner 18.

The liner border 18*b* may then be readily removed from the label border 14*b* so that the exposed adhesive 20 behind the label border may be used for bonding the remaining laminate to the container as illustrated in FIG. 1.

As shown in FIG. 4, the adhesive skip 26 is preferably slightly larger in configuration and area than the release skip 28 to prevent unintended bonding of the label to the release skip. The label and liner borders may have any convenient size, with the label border 14*b* being preferably larger than the liner border so that removal of the liner exposes sufficient adhesive on the back of the label border for securely affixing the remaining shipping laminate to the container.

As shown in FIG. 3, the adhesive skip 26 is preferably offset or recessed from the label die cut 34 to provide an adhesive border for securely affixing the removed label 14 atop the return address 24 as illustrated in FIG. 2 if desired. Correspondingly, the release skip 28 is also preferably offset or recessed from the liner die cut 36 to ensure that the label 14 is bonded to the liner 18 around its full perimeter. Since the adhesive 20 forms a relatively weak bond with the release 22, maximum area of that bond is desired to ensure integrity of the label and liner without premature liberation of the label.

The exemplary release skip 28 illustrated in FIG. 3 has a rectangular configuration occupying a small portion of the entire area of the liner and overlying label 14 for leaving a majority of area for any desired printing and for maintaining a good bond between the label and liner prior to separation. The release skip may take any other suitable configuration and may be used wherever printing is desired atop a liner without interference by the surrounding release agent.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. A label laminate comprising:

an adhesive label having an adhesive covering a back surface of said label except for a portion of said label defining a skip devoid of said adhesive;

a release liner having a surface release thereon except for a portion of said liner defining a release skip devoid of said release; and said label being laminated atop said liner by said adhesive and release thereof, with said label and adhesive being peelably removable from said liner, and with said adhesive skip being aligned atop said release skip for preventing bonding thereat.

2. A laminate according to claim 1 wherein said release skip in said liner has a surface finish receptive for printing thereatop.

3. A laminate according to claim 2 further comprising a border surrounding said label and having a surface adhesive thereon bonding said border to said liner.

4. A laminate according to claim 3 wherein:

said label and border comprise a common face sheet including a perimeter die cut therebetween; and said liner is surrounded by a border in a common back sheet separated by a perimeter die cut therebetween.

5. A method of using said laminate according to claim 4 for addressing a shipping container, comprising:

printing a recipient first address atop said label;

printing a recipient second address below said release;

affixing said laminate to said container;

sending said container to said first address;

removing said label from said liner to expose said second address and said release skip;

printing atop said release skip; and resending said container to said second address.

6. A laminate according to claim 4 wherein said adhesive skip is larger than said release skip.

7. A laminate according to claim 4 wherein said adhesive skip is offset from said label die cut, and said release skip is offset from said liner die cut.

8. A laminate according to claim 4 further comprising an ink receptor disposed atop said release skip in said liner.

9. A shipping laminate comprising:

an adhesive label having an adhesive covering a back surface of said label except for a portion of said label defining a skip devoid of said adhesive;

a release liner having a surface release thereon except for a portion of said liner defining a release skip devoid of said release, and said release skip has a surface finish receptive for printing thereatop;

said label being laminated atop said liner by said adhesive and release thereof, with said label and adhesive being peelably removable from said liner, and with said adhesive skip being aligned atop said release skip for preventing bonding thereat; and a border surrounding said label and having a surface adhesive thereon bonding said border to said liner.

10. A laminate according to claim 9 further comprising:

a recipient first address printed atop said label; and a recipient second address printed below said release.

11. A laminate according to claim 10 wherein:

said label and border comprise a common face sheet including a perimeter die cut therebetween; and said liner is surrounded by a border in a common back sheet separated by a perimeter die cut therebetween.

12. A laminate according to claim 11 wherein said adhesive skip is larger than said release skip.

13. A laminate according to claim 12 wherein said adhesive skip is offset from said label die cut, and said release skip is offset from said liner die cut.

14. A laminate according to claim 9 further comprising an ink receptor disposed atop said release skip in said liner.

15. A label laminate comprising an adhesive coated label adhesively laminated to a release coated release liner, and said label includes an adhesive skip in a portion thereof, and said liner includes a release skip in a portion thereof aligned with said adhesive skip for preventing bonding therebetween, with said label adhesive being removably bonded to said liner release around said aligned adhesive and release skips.

16. A laminate according to claim 15 wherein said adhesive surrounds said adhesive skip, and said release surrounds said release skip.

17. A laminate according to claim 1 wherein said adhesive surrounds said adhesive skip, and said release surrounds said release skip.

18. A laminate according to claim 9 wherein said adhesive surrounds said adhesive skip, and said release surrounds said release skip.

19. A method of using said laminate according to claim 9 for addressing a shipping container, comprising:

printing a recipient first address atop said label;

printing a recipient second address below said release;

affixing said laminate to said container;

sending said container to said first address;

removing said label from said liner to expose said second address and said release skip;

printing atop said release skip; and resending said container to said second address.

20. A method of using said laminate according to claim 15 for addressing a shipping container, comprising:

printing a recipient first address atop said label;

printing a recipient second address below said release;

affixing said laminate to said container;

sending said container to said first address;

removing said label from said liner to expose said second address and said release skip;

printing atop said release skip; and resending said container to said second address.

* * * * *